US008567379B2

(12) United States Patent
Hu

(10) Patent No.: US 8,567,379 B2
(45) Date of Patent: Oct. 29, 2013

(54) FIRING LINKAGE MECHANISM FOR TOY SUBMACHINE GUN

(76) Inventor: Shih-Che Hu, Tainan (TW)

( * ) Notice: Subject to any disclaimer, the term of this patent is extended or adjusted under 35 U.S.C. 154(b) by 137 days.

(21) Appl. No.: 13/300,687

(22) Filed: Nov. 21, 2011

(65) Prior Publication Data

US 2013/0087130 A1 Apr. 11, 2013

(30) Foreign Application Priority Data

Oct. 7, 2011 (TW) ..... 100136495

(51) Int. Cl.
*F41B 11/16* (2006.01)

(52) U.S. Cl.
USPC ..... 124/60; 124/56

(58) Field of Classification Search
USPC ..... 124/57–64
See application file for complete search history.

(56) References Cited

U.S. PATENT DOCUMENTS

| | | | | |
|---|---|---|---|---|
| 3,262,440 | A * | 7/1966 | Kuhn | 124/67 |
| 5,156,137 | A * | 10/1992 | Clayton | 124/27 |
| 6,439,216 | B1 * | 8/2002 | Johnson et al. | 124/70 |
| 6,648,726 | B2 * | 11/2003 | Hornsby et al. | 446/483 |
| 7,267,118 | B2 * | 9/2007 | Eddins et al. | 124/63 |
| 8,448,365 | B2 * | 5/2013 | Mead et al. | 42/54 |
| 2013/0118465 | A1 * | 5/2013 | Nugent | 124/65 |

* cited by examiner

*Primary Examiner* — Michael David
(74) *Attorney, Agent, or Firm* — Raymod Y. Chan; David and Raymond Patent Firm

(57) ABSTRACT

A firing linkage mechanism for submachine gun includes a link biasable forwardly following a forward displacement of a firing pin and an air plug upon striking of a hammer against the firing pin and forcible to return the firing pin and the air plug after the striking action of the hammer, and a stop rod for engaging the link to hold the link, the firing pin and the air plug in position and to stop the link from returning the firing pin and the air plug after the striking action of the hammer and movable by a counterweight set to release the link for stopping a compressed gas from flowing out of a magazine into a bolt when the counterweight set is moved along oblique sliding rail portions of sliding rails in the submachine gun.

7 Claims, 8 Drawing Sheets

FIRING LINKAGE MECHANISM FOR TOY SUBMACHINE GUN

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to toy submachine gun and more particularly, to a firing linkage mechanism for toy submachine gun, which simulates the operation of a real submachine gun to achieve intake of compressed gas upon striking of the hammer against the firing pin and stoppage of gas charge upon backward displacement of the bolt, reducing recoil and avoiding muzzle jump during firing.

2. Description of Related Arts

Regular toy guns are common designed to simulate real guns. Except the simulation of the physical outer appearance, a toy gun may also provide a recoil function to attract toy gun players.

Further, a submachine gun has the advantages of fast shooting speed and strong firepower; however, it has the drawbacks of high recoil and poor shooting control. Therefore, gun manufacturers created real guns with reduced recoil and control characteristics (such as U.S. Pat. Nos. 7,201,094; 7,997,183). These reactions employs a technique to transfer the amount of recoil downwards, avoiding transfer of the recoil to the shooter's hand or shoulder. A real gun of this design reduces recoil, avoids muzzle jump during firing. Further, the number of component parts (including movable parts) of a real gun of this design is minimized. The weight of a real gun of this design can be reduced over 50% when compared to conventional real guns. A real gun of this design uses an improved recoil control device comprising a bolt head and an inertia block. The bolt head and inertial block are articulated so that the displacement of the bolt head results in a force component outside the firing axis of the barrel of the firearm. When incorporated into a submachine gun, the recoil control device produces recoil reduction and weight reduction advantages.

By means of employing a technique to transfer the amount of recoil downwards, the aforesaid real gun design produces recoil reduction and weight reduction advantages. However, the aforesaid real gun design is gunpowder actuated. Unlike a real gun, a toy gun uses compressed gas or spring power to drive the firing pin. The structural design of the aforesaid improved recoil control device cannot be directly used in a toy gun or toy submachine gun.

SUMMARY OF THE PRESENT INVENTION

The present invention has been accomplished under the circumstances in view. It is therefore the main object of the present invention to provide a firing linkage mechanism for toy submachine gun, which simulates the operation of a real submachine gun to achieve intake of compressed gas upon striking of the hammer against the firing pin and stoppage of gas charge upon backward displacement of the bolt, reducing recoil and avoiding muzzle jump during firing.

To achieve this and other objects of the present invention, a firing linkage mechanism is used in a toy submachine gun comprising a gun body, a magazine holder mounted in the gun body and holding a magazine, two sliding rails bilaterally mounted inside the gun body. Each sliding rail comprises a horizontal sliding rail portion and an oblique sliding rail portion obliquely and downwardly extended from the rear end of the horizontal sliding rail portion. The linkage mechanism comprises a hammer, an air plug, a bolt, and a counterweight set. The air plug is mounted in the top side inside the magazine holder, having the rear end thereof stopped against a firing pin. The bolt is mounted inside the gun body above the magazine holder, comprising a gas inlet at the bottom side thereof. The counterweight set is pivotally mounted at the rear side of the bolt. The hammer is adapted for striking the firing pin against the air plug to let a compressed gas flow out of the magazine into the gas inlet to move the bolt along the sliding rails for enabling the counterweight set to move downwardly along the oblique sliding rail portions of the sliding rails. The firing linkage mechanism further comprises a side frame bar, a link and a stop rod. The side frame bar is mounted at one side of the magazine holder. The link is pivotally coupled between the side frame bar and the firing pin, biasable forwardly following a forward displacement of the firing pin and the air plug upon striking of the hammer against the firing pin, and forcible to return the firing pin and the air plug after the striking action of the hammer. The stop rod is adapted for engaging the link to hold the link, the firing pin and the air plug in position and to stop the link from returning the firing pin and the air plug after the striking action of the hammer The stop rod is moved by the counterweight set to release the link when the counterweight is moved along the oblique sliding rail portions of the sliding rails, enabling the firing pin and the air plug to be returned to stop the compressed gas from flowing out of the magazine into the gas inlet.

Further, the link comprises a notch. The stop rod comprises a retaining portion located on the top end thereof and adapted for engaging the notch of the link, a middle part pivotally connected to the side frame bar, and a butt disposed at the bottom end thereof forcible by the counterweight set to bias the stop rod in disengaging the retaining portion from the notch of the link during downward movement of the counterweight set along the oblique sliding rail portions of the sliding rails.

Further, the counterweight set comprises two counterweights and a holder frame. The two counterweights are fixedly mounted at the holder frame at two sides. Each holder frame comprises a push portion adapted for pushing the butt of the stop rod to bias the stop rod in disengaging the retaining portion from the notch of the link when the counterweight set is forced to move downwardly along the oblique sliding rail portions of the sliding rails.

The firing linkage mechanism further comprises a bottom block located on the bottom side of the gun body and spaced below the counterweight set, a first spring member set between the holder frame of the counterweight set and the bottom block and adapted for pushing the counterweight set upwardly to move the bolt forwardly along the sliding rails to the former position after downward displacement of the counterweight set, a second spring member stopped between the middle part of the link and the side frame bar, and a third spring member set between the stop rod and the side frame bar. Further, each counterweight comprises an oblique slot. Further, the bolt comprises a guide rod transversely located on the rear side thereof and coupled with two distal ends thereof to the oblique slots of the counterweights.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
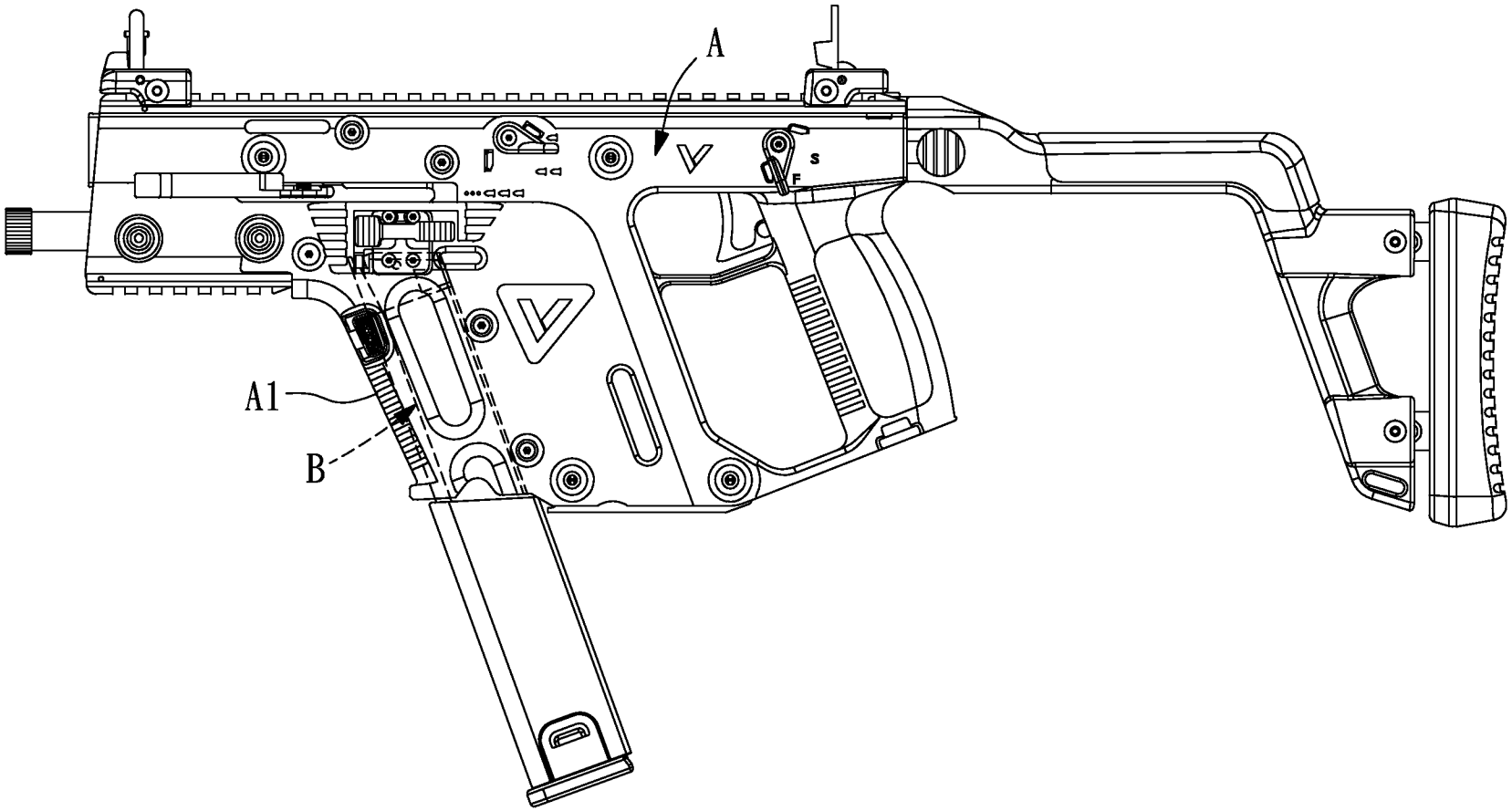
FIG. 1 is a perspective view of a toy submachine gun embodying the present invention.
Figure 2:
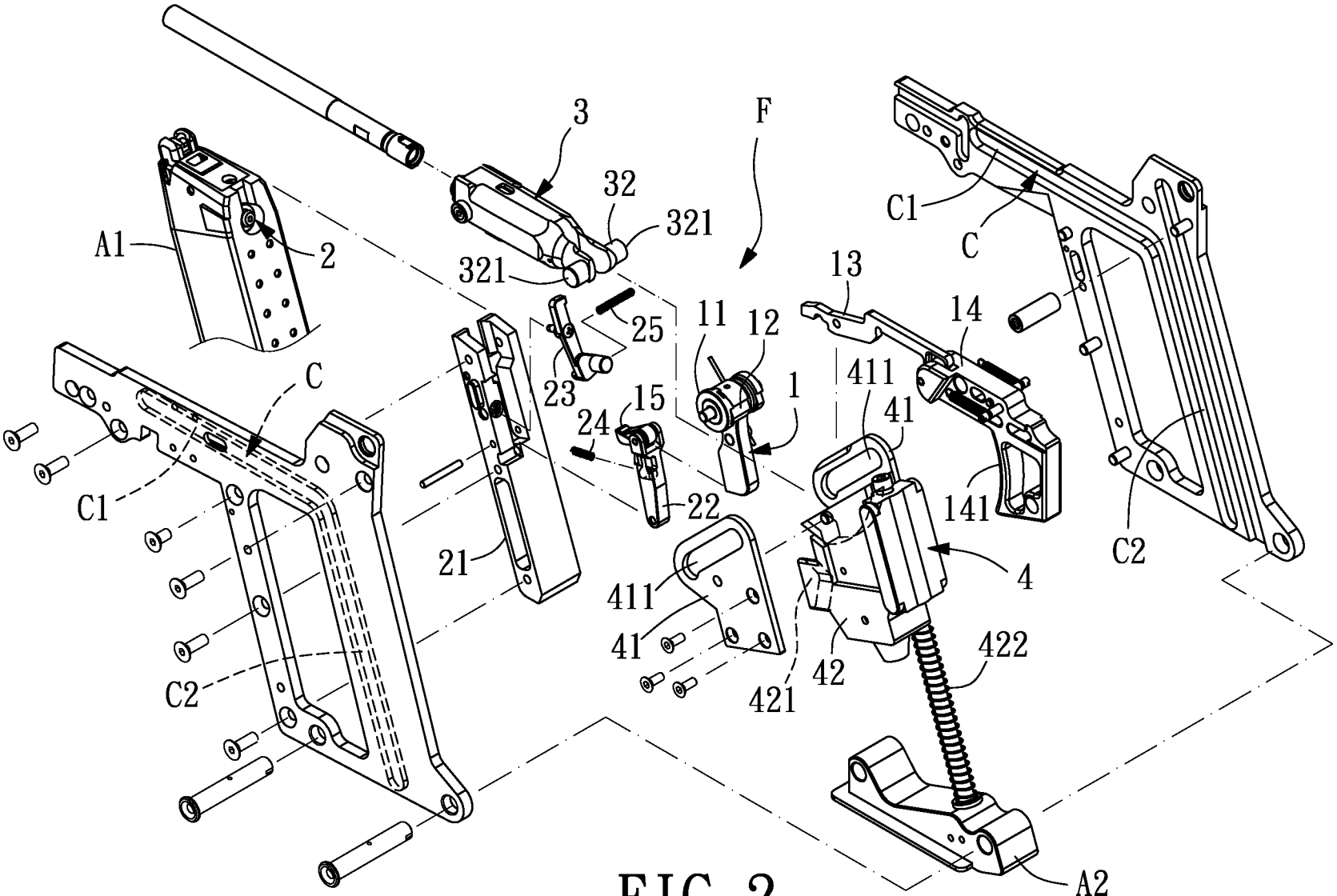
FIG. 2 is an exploded view of the firing linkage mechanism of the toy submachine gun shown in FIG. 1.

Referring to FIG. 1, a toy submachine gun is shown, wherein the toy submachine gun comprises a gun body A having a magazine holder A1 for holding a magazine B and two sliding rails C being bilaterally and symmetrically arranged on the inside wall of the gun body A. In this embodiment, as shown in FIG. 2, each of the sliding rails C is a sliding grooved rail formed on a respective plat member and affixed to the inside wall of the gun body A. Each sliding rail C comprises a horizontal sliding rail portion C1 and an oblique sliding rail portion C2 backwardly and downwardly extended from one end thereof, namely, the rear end of the horizontal sliding rail portion C1. The toy submachine gun further comprises a firing linkage mechanism F which comprises a hammer 1, an air plug 2, a bolt 3 and a counterweight set 4.

The hammer 1 comprises a base 11 pivotally mounted at the inside of the gun body A (see FIG. 3), and a retaining groove 12 located on the base 11 for the engagement of one end of a trigger bar 13 to stop the hammer 1 from action. The trigger bar 13 has its other end pivotally connected to a trigger frame 14, which comprises a trigger 141. When biasing the trigger 141 (see FIG. 4), the trigger bar 13 will be moved away from the retaining groove 12, releasing the hammer 1 and enabling the hammer 1 to strike the firing pin 15.

Figure 4:
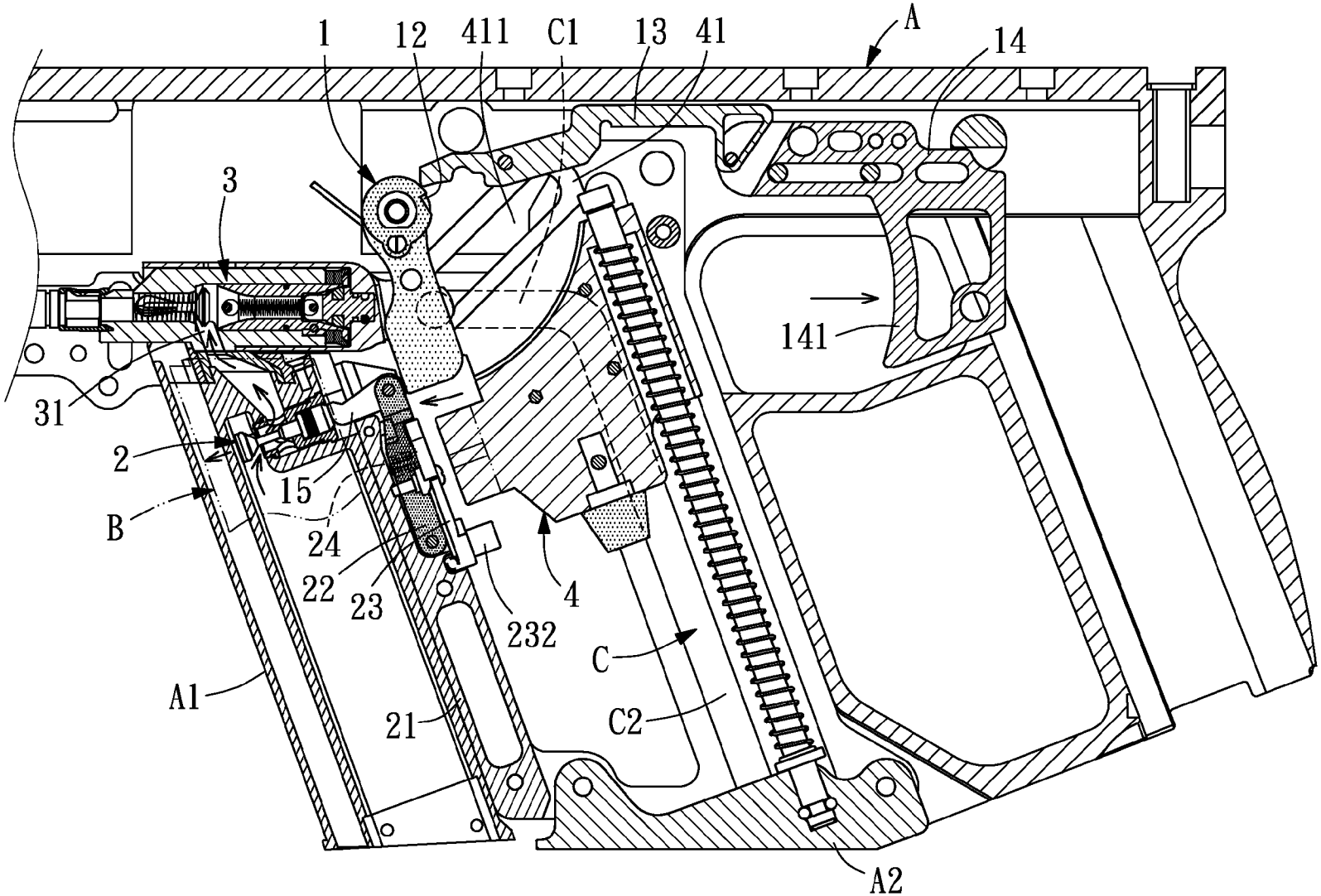
FIG. 4 corresponds to FIG. 3, illustrating the status of the firing linkage mechanism during intake of compressed gas.
Figure 5:
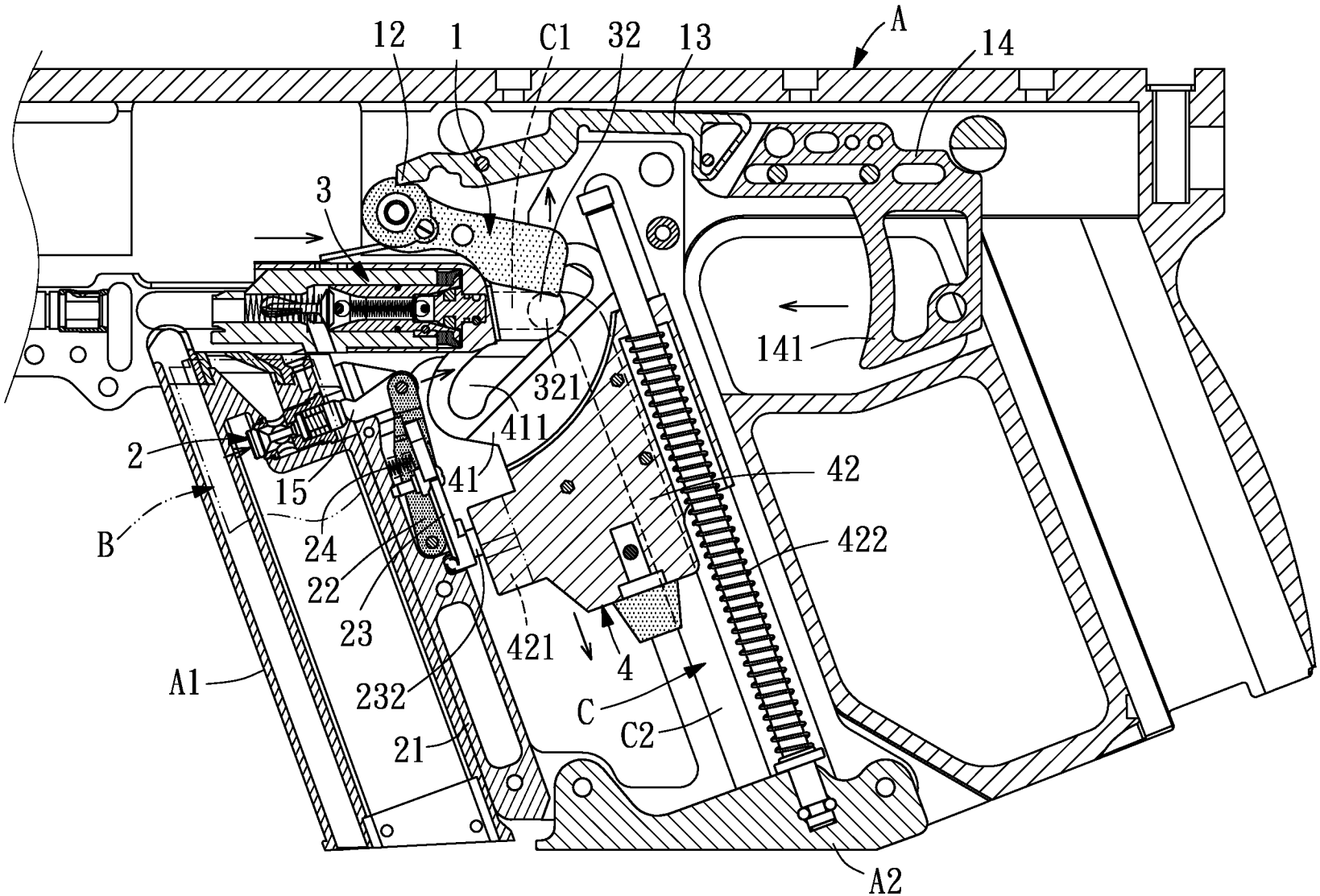
FIG. 5 corresponds to FIG. 4, illustrating the status of the firing linkage mechanism upon interruption of gas intake.
Figure 6:
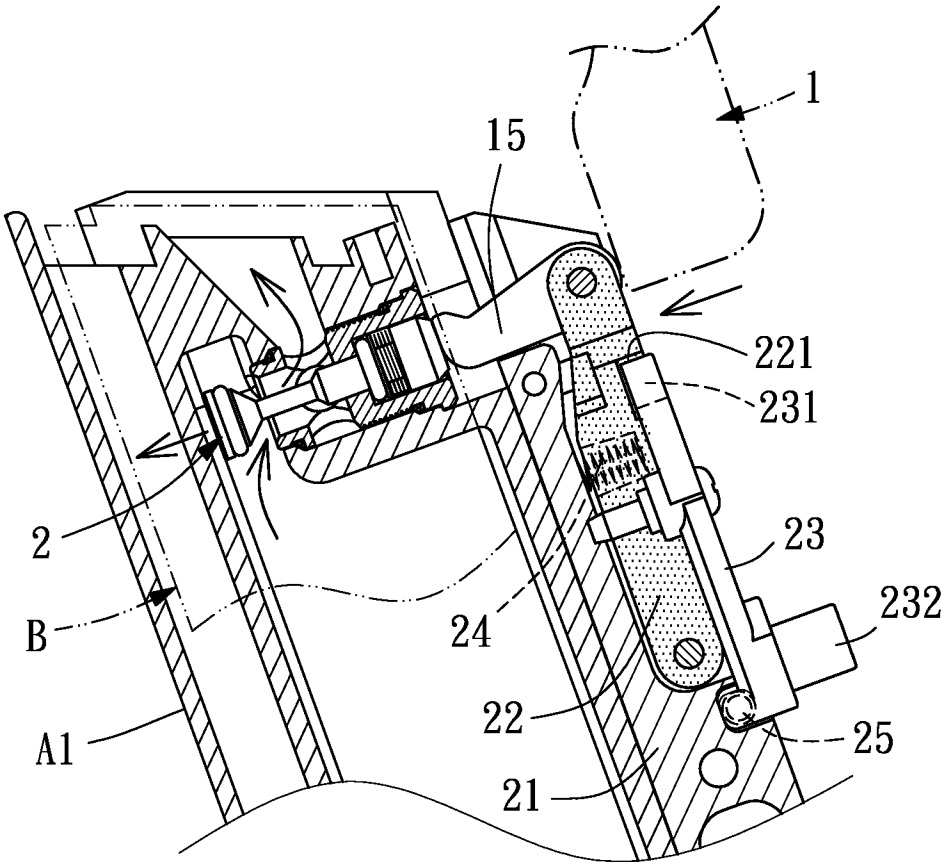
FIG. 6 is a schematic plain view of the present invention, illustrating the status of the firing linkage mechanism during a firing action.
Figure 7:
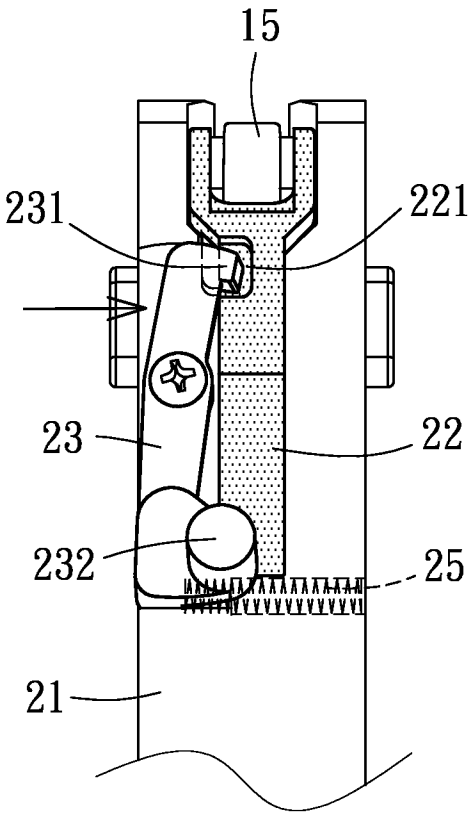
FIG. 7 corresponds to FIG. 6 when viewed from the right side.

The air plug 2 is mounted in a top side inside the magazine holder A1 (see FIG. 3), and stopped by the firing pin 15. A side frame bar 21 is mounted at one side of the magazine holder A1. A link 22 is pivotally coupled between the side frame bar 21 and the firing pin 15. A second spring member 24 is mounted at the side frame bar 21 and stopped against a middle part of the link 22. When the hammer 1 strikes the firing pin 15, the firing pin 15 and the air plug 2 are moved forwards, and the link 22 is turned forwardly following the forward displacement of the firing pin 15 and the air plug 2 (see FIG. 4). After the striking action, the second spring member 24 immediately forces the link 22 to return the firing pin 15 and the air plug 2 to their former positions (see FIG. 5). Further, the link 22 has a notch 221 (see FIG. 6). A stop rod 23 is coupled to the side frame bar 21. The stop rod 23 has a middle part thereof pivotally connected to the side frame bar 21, a top end terminating in a retaining portion 231, and a bottom end connected to a third spring member 25 at the side frame bar 21. When the link 22 is biased forwardly, the stop rod 23 is forced to engage the retaining portion 231 into the notch 221 of the link 22 (see FIG. 7), holding the link 22, the firing pin 15 and the air plug 2 in position for letting in a compressed flow of gas. Further, the stop rod 23 has a butt 232 at the bottom end thereof. Applying a force to the butt 232 (see FIG. 4) can bias the stop rod 23 to disengage the retaining portion 231 from the notch 221 of the link 22 (see FIGS. 8 and 9), causing the firing pin 15 and the air plug 2 to be moved backwards to interrupt gas charge.

The bolt 3 is mounted inside the gun body A on the barrel axis of the gun barrel (see FIG. 3; the gun barrel is not shown) above the magazine A1, having a gas inlet 31 at the bottom side thereof. When the hammer 1 strikes the firing pin 15 against the air plug 2, the internal compressed gas of the magazine B goes into the gas inlet 31 (see FIG. 4), moving the bolt 3 backwardly along the sliding rails C (see FIG. 5). When the firing pin 15 and the air plug 2 are moved backwards, the internal compressed gas of the magazine B is prohibited from entering the gas inlet 31 of the bolt 3, and therefore gas charge is stopped. Further, the bolt 3 has a guide rod 32 transversely located on the rear side thereof (see FIG. 5). The two opposite ends 321 of the guide rod 32 are respectively coupled to the sliding rails C such that the bolt 3 can be moved along the sliding rails C. Further, after firing, the bolt 3 is moved backwardly along the sliding rails C to move the hammer 1 backwardly and upwardly to its former position.

The counterweight set 4 comprises two counterweights 41 and a holder frame 42. The two counterweights 41 are fixedly mounted at the holder frame 42 at two sides (see FIG. 2). Each of the counterweights 41 has an oblique slot 411. The two opposite ends 321 of the guide rod 32 of the bolt 3 are respectively inserted through the oblique slots 411 of the counterweights 41 and then coupled to the sliding rails C (see FIG. 3), i.e., the counterweights 41 are respectively coupled to the two opposite ends 321 of the guide rod 32 of the bolt 3 by the respective oblique slots 411. Thus, when the bolt 3 is forced to move along the sliding rails C, the counterweight set 4 will be forced to move downwardly along the oblique sliding rail portions C2 of the sliding rails C. Further, the holder frame 42 of the counterweight set 4 comprises a push portion 421. When the counterweight set 4 is forced to move downwardly along the oblique sliding rail portions C2 of the sliding rails C, the push portion 421 will push the butt 232 of the stop rod 23 (see FIG. 5) to bias the stop rod 23, causing the stop rod 23 to disengage its retaining portion 231 from the notch 221 of the link 22. After disengagement of the retaining portion 231 of the stop rod 23 from the notch 221 of the link 22, the firing pin 15 and the air plug 2 will be moved backwards to interrupt gas charge (see FIGS. 8 and 9). The gun body A further comprises a bottom block A2 spaced below the counterweight set 4. Further, a first spring member 422 is set between the holder frame 42 of the counterweight set 4 and the bottom block A2. Thus, after downward displacement of the counterweight set 4, the first spring member 422 pushes the counterweight set 4 upwardly to move the bolt 3 forwardly along the sliding rails C to its former position (see FIG. 10).

Figure 3:
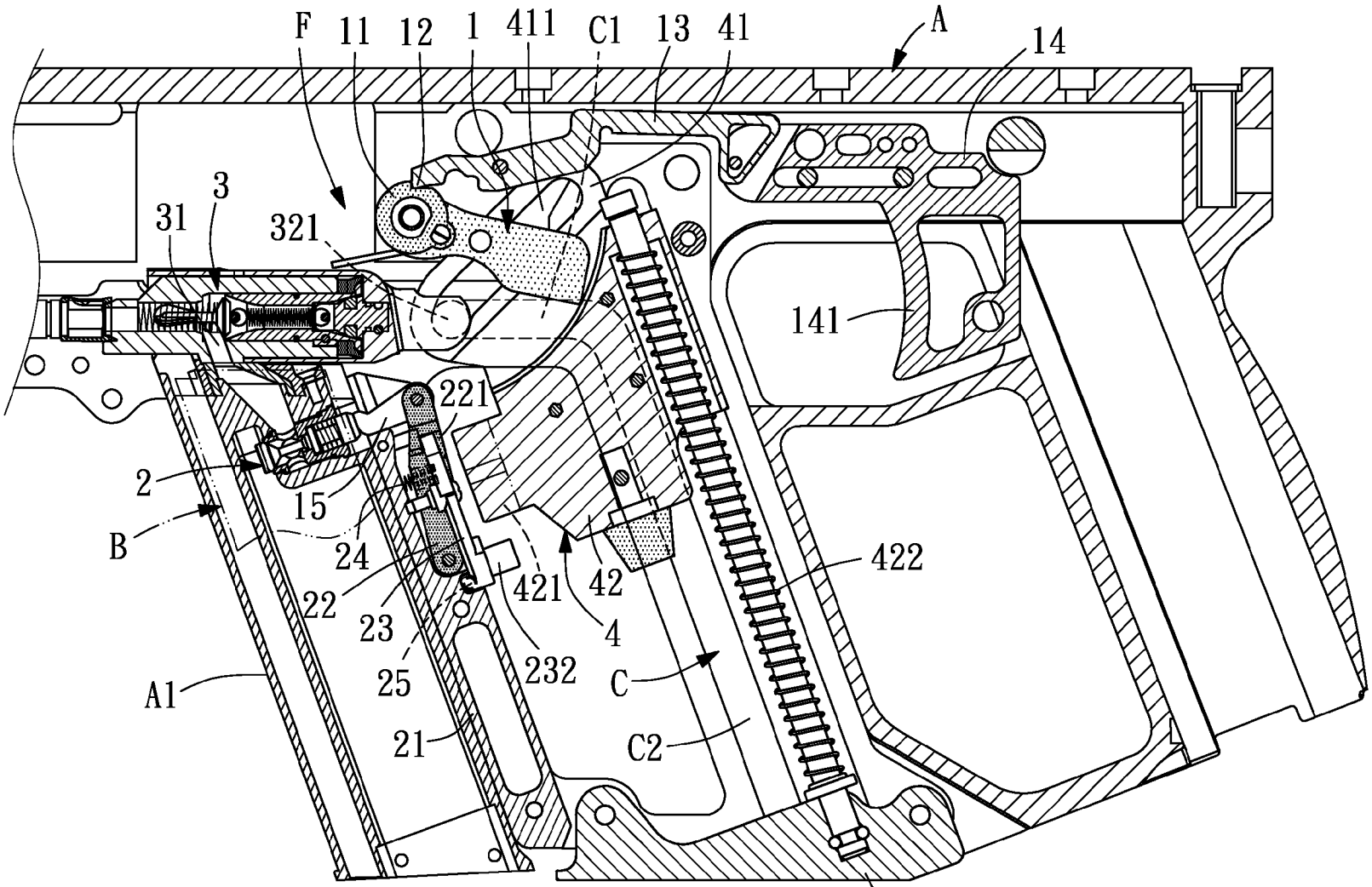
FIG. 3 is a schematic plain view illustrating the status of the firing linkage mechanism before a firing action.

FIG. 3 illustrates a status of the firing linkage mechanism before a firing action. When firing, the hammer 1 is biased forwardly and downwardly to strike the firing pin 15 (see FIG.

4) against the air plug 2. At this time, the link 22 is biased forwardly and, the stop rod 23 is forced by the third spring member 25 to engage its retaining portion 231 into the notch 221 of the link 22 (see FIGS. 6 and 7), holding the link 22, the firing pin 15 and the air plug 2 in position for letting a compressed flow of gas to flow from the magazine B through the gas inlet 31 into the bolt 3 to drive out an air-soft bullet (plastic BB bullet). At the same time, the bolt 3 is moved backwardly along the sliding rails C (see FIG. 5), the hammer 1 is returned to its former position, and the counterweight set 4 is moved backwardly and downwardly along the oblique sliding rail portions C2 of the sliding rails C.

Figure 9:
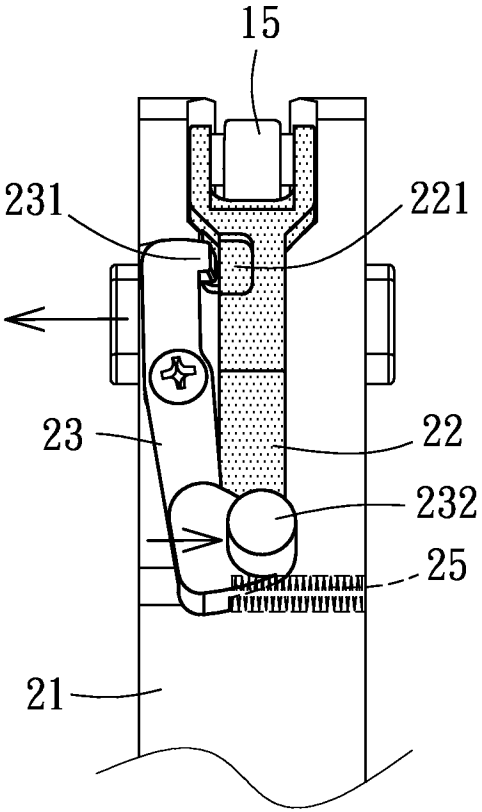
FIG. 9 corresponds to FIG. 8 when viewed from the right side.
Figure 8:
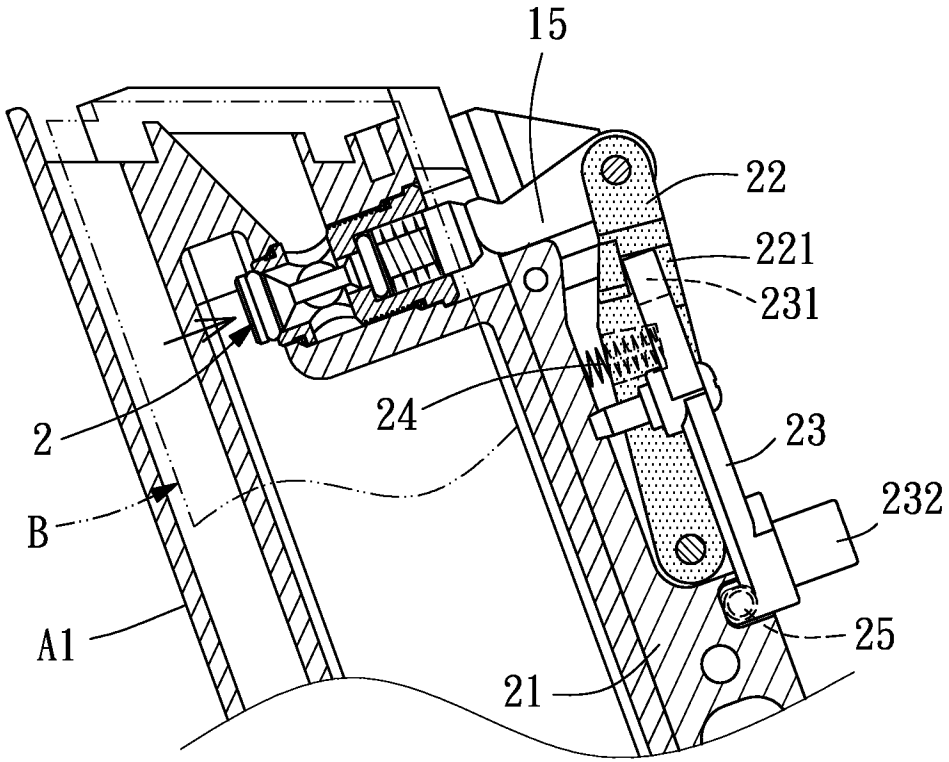
FIG. 8 is an enlarged view of a part of FIG. 5.
Figure 10:
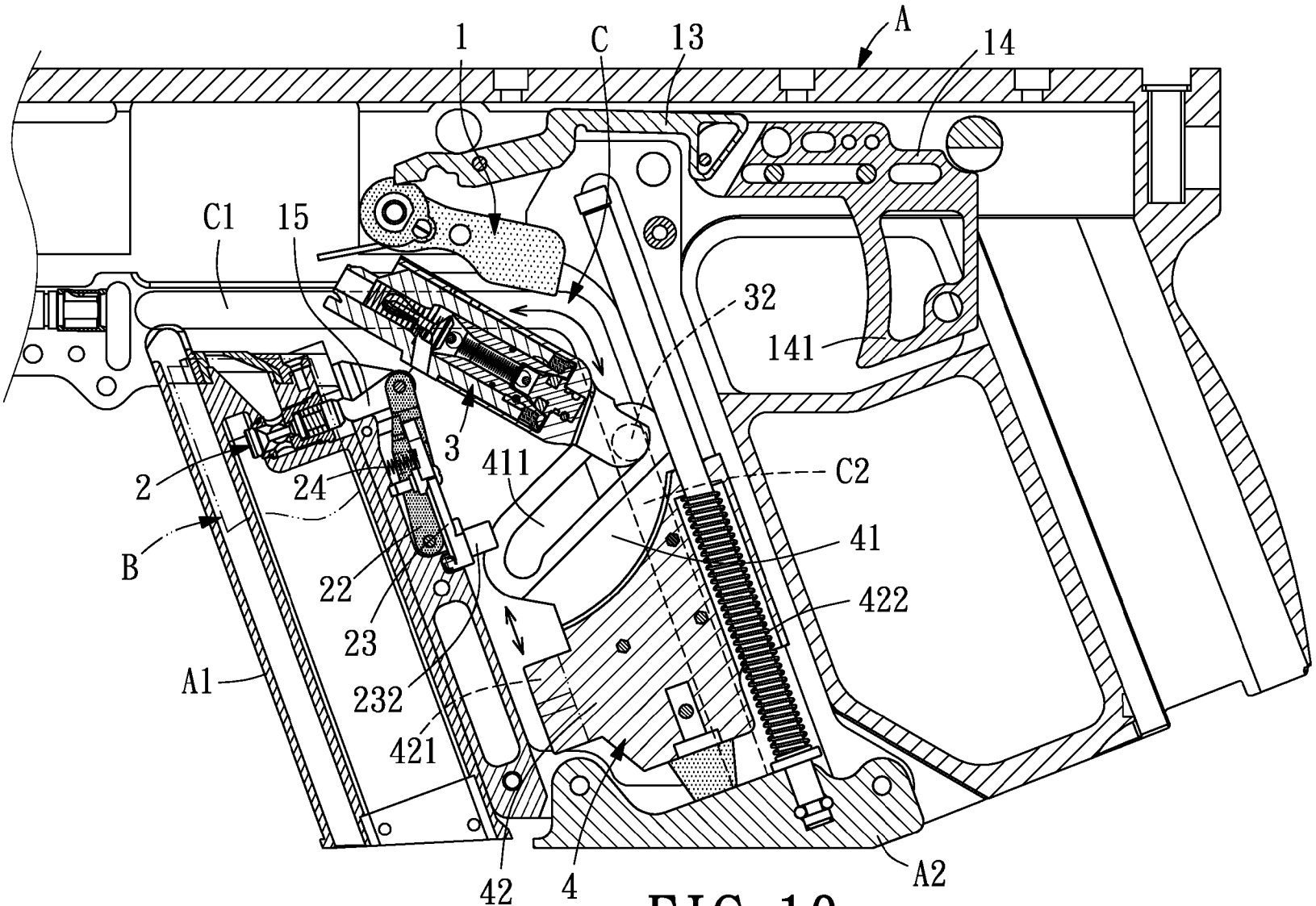
FIG. 10 is a schematic plain view of the present invention, illustrating the displacement path of the bolt and counterweight set of the firing linkage mechanism.

When the push portion 421 of the holder frame 42 of the counterweight set 4 touches the butt 232 of the stop rod 23 during downward movement of the counterweight set 4 along the oblique sliding rail portions C2 of the sliding rails C, the push portion 421 will push the butt 232 of the stop rod 23 to bias the stop rod 23, causing the stop rod 23 to disengage its retaining portion 231 from the notch 221 of the link 22 (see FIGS. 8 and 9). After disengagement of the retaining portion 231 of the stop rod 23 from the notch 221 of the link 22, the second spring member 24 forces the link 22 to bias backwardly, and therefore the firing pin 15 and the air plug 2 are moved backwards to interrupt gas charge. When the counterweight set 4 reaches the lower limit position during its downward movement (see FIG. 10), the first spring member 422 immediately returns the counterweight set 4, causing the bolt 3 to be moved forwardly along the sliding rails C to its former position (see FIG. 3) for a next firing cycle.

As stated above, the structural design of the firing linkage mechanism of the above-described toy submachine gun achieves the designed targets in gas intake and interruption of gas intake. Similar to a real submachine gun, the toy submachine gun embodying the present invention adopts a delayed recoil operation design to reduce recoil, avoiding muzzle jump during firing. Thus, the toy submachine gun provides a high level of quality and effectively simulates a real submachine gun.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A firing linkage mechanism used in a toy submachine gun comprising a gun body, a magazine holder mounted in said gun body and holding a magazine, two sliding rails bilaterally mounted inside said gun body, each said sliding rail comprising a horizontal sliding rail portion and an oblique sliding rail portion obliquely downwardly extended from a rear end of said horizontal sliding rail portion, said firing linkage mechanism comprising a hammer, an air plug, a bolt and a counterweight set, said air plug being mounted in a top side inside said magazine holder and having a rear end thereof stopped against a firing pin, said bolt being mounted inside said gun body above said magazine holder and comprising a gas inlet at a bottom side thereof, said counterweight set being pivotally mounted at a rear side of said bolt, said hammer being adapted for striking said firing pin against said air plug to let a compressed gas flow out of said magazine into said gas inlet to move said bolt along said sliding rails for enabling said counterweight set to move downwardly along the oblique sliding rail portions of said sliding rails; wherein: said firing linkage mechanism further comprises a side frame bar, a link and a stop rod, said side frame bar being mounted at one side of said magazine holder, said link being pivotally coupled between said side frame bar and said firing pin and biasable forwardly following a forward displacement of said firing pin and said air plug upon striking of said hammer against said firing pin and forcible to return said firing pin and said air plug after the striking action of said hammer, said stop rod being adapted for engaging said link to hold said link, said firing pin and said air plug in position and to stop said link from returning said firing pin and said air plug after the striking action of said hammer, said stop rod being moved by said counterweight set to release said link for enabling said firing pin and said air plug to be returned to stop said compressed gas from flowing out of said magazine into said gas inlet when said counterweight set is moved along the oblique sliding rail portions of said sliding rails.

2. The firing linkage mechanism as claimed in claim 1, wherein said link comprises a notch; said stop rod comprises a retaining portion located on a top end thereof and adapted for engaging the notch of said link.

3. The firing linkage mechanism as claimed in claim 2, wherein said stop rod comprises a middle part pivotally connected to said side frame bar and a butt disposed at a bottom end thereof and forcible by said counterweight set to bias said stop rod in disengaging said retaining portion from the notch of said link during a downward movement of said counterweight set along the oblique sliding rail portions of said sliding rails.

4. The firing linkage mechanism as claimed in claim 3, wherein said counterweight set comprises two counterweights and a holder frame, said two counterweights being fixedly mounted at said holder frame at two sides, said holder frame comprising a push portion adapted for pushing said butt of said stop rod to bias said stop rod in disengaging said retaining portion from the notch of said link when said counterweight set is forced to move downwardly along the oblique sliding rail portions of said sliding rails.

5. The firing linkage mechanism as claimed in claim 4, further comprising a bottom block located on a bottom side of said gun body and spaced below said counterweight set, and a first spring member set between said holder frame of said counterweight set and said bottom block and adapted for pushing said counterweight set upwardly to move said bolt forwardly along said sliding rails to the former position after a downward displacement of said counterweight set, wherein each said counterweight comprises an oblique slot; said bolt comprises a guide rod transversely located on a rear side thereof and coupled to the oblique slots of said counterweights.

6. The firing linkage mechanism as claimed in claim 5, further comprising a second spring member stopped between a middle part of said link and said side frame bar.

7. The firing linkage mechanism as claimed in claim 6, further comprising a third spring member set between said stop rod and said side frame bar.

* * * * *